US007711304B2

(12) United States Patent
Horie

(10) Patent No.: US 7,711,304 B2
(45) Date of Patent: May 4, 2010

(54) FIXING DEVICE AND IMAGE FORMING APPARATUS

(75) Inventor: Takayuki Horie, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 3 days.

(21) Appl. No.: 11/870,927

(22) Filed: Oct. 11, 2007

(65) Prior Publication Data

US 2008/0095557 A1 Apr. 24, 2008

(30) Foreign Application Priority Data

Oct. 23, 2006 (JP) ..... 2006-287306

(51) Int. Cl.
*G03G 15/20* (2006.01)

(52) U.S. Cl. ..... 399/329

(58) Field of Classification Search ..... 399/329, 399/320, 323, 123

See application file for complete search history.

(56) References Cited

U.S. PATENT DOCUMENTS 5,614,999 A * 3/1997 Kanesawa et al. ..... 399/329
5,999,788 A * 12/1999 Kanesawa et al. ..... 399/329
7,020,424 B2 * 3/2006 Gilmore et al. ..... 399/329
2007/0071522 A1 * 3/2007 Kaji et al. ..... 399/329

FOREIGN PATENT DOCUMENTS

JP 5-150679 6/1993
JP 8-166734 6/1996

* cited by examiner

*Primary Examiner*—David M Gray
*Assistant Examiner*—Andrew V Do
(74) *Attorney, Agent, or Firm*—Cantor Colburn LLP

(57) ABSTRACT

A fixing device may include a fixing roller, an endless fixing belt, a pressing member forming a first nip portion between the fixing roller and the fixing belt, and a separating member forming a second nip portion between the fixing roller and the fixing belt. The first nip portion and the second nip portion may satisfy the formulas $P1 \times \mu 1 > P2 \times \mu 2$, and $\mu 1 > \mu 2$, wherein P1 represents a total load to the fixing roller applied by the pressing member at the first nip portion, P2 represents a total load to the fixing roller applied by the separating member at the second nip portion, $\mu 1$ represents a frictional coefficient between the fixing belt and the sliding surface of the pressing member, and $\mu 2$ represents a frictional coefficient between the fixing belt and the sliding surface of the separating member.

6 Claims, 2 Drawing Sheets

FIXING DEVICE AND IMAGE FORMING APPARATUS

RELATED APPLICATION

This application is based on Japanese Patent Application No. 2006-287306 filed on Oct. 23, 2006 in Japan Patent Office, the entire content of which is hereby incorporated by reference.

TECHNICAL FIELD

The present invention relates to a fixing device for fixing a toner image on a sheet, particularly a fixing device having a fixing belt and an image forming apparatus having the fixing device for forming an image such as a copying machine, a printer, or a facsimile.

BACKGROUND

As a fixing device used for an electrophotographic image forming apparatus such as a copying machine, a facsimile, or a printer, a fixing device of a heat roller fixing type is adopted widely. The fixing device of the heat roller fixing type conveys a sheet to a nip portion formed by a fixing roller controlled at a predetermined temperature and a pressing roller in pressure contact with the fixing roller, heats and pressurizes a non-fixed toner image on the sheet surface, thereby fixes it.

However, widening the fixing nip portion is required to heat toner efficiently on the sheet surface by the demand for colorization and speedup in late years. However, viewing the constitution of the fixing device of a heat roller fixing type, a means for enlarging the diameters of the two rollers or increasing the pressurizing force between the rollers, thereby increasing the collapse (distortion) amount of the rollers would be considered to widen the nip portion. However, there may arise a problem in respect to the enlargement of the size of the fixing device and the reduction in durability of the fixing device and the degree of freedom of design conditions is low.

As a method for solving this problem, a fixing device of a fixing belt type having an rotating endless fixing belt driven by a fixing roller and a pressing pad fixed on the inner peripheral surface side of the fixing belt and pressing the fixing belt toward the fixing roller by the pressing pad has been adopted in recent years. In the fixing device of a fixing belt type, from the viewpoint of its constitution, the nip width can be set comparatively freely.

In the fixing device of a fixing belt type, the shape of the nip portion is in a circular arc shape along the fixing roller, so that defective separation of a sheet from the fixing roller is caused easily. Defective separation of a sheet is that the sheet passing the nip portion may be conveyed without separated normally from the fixing roller kept wound round it. It is easy to happen the defective separation of a sheet especially when a coated paper with high surface smoothness and a thin paper with low rigidity are used.

As a method for avoiding such defective separation of a sheet, Japanese Patent Application Publication NO. 5-150679 discloses a fixing device wherein a pressure roller is installed inside the fixing belt at the exit of the nip portion, and the fixing roller is distorted, thus the sheet peeling (separation) performance is improved.

However, when the pressure roller is installed and the fixing roller is distorted, a sheet conveying speed V2 at that portion (hereinafter, referred to as a second nip portion) is higher than a conveying speed V1 of the other part (hereinafter, referred to as a first nip portion) which is not distorted.

When the pressurizing force (total load) to the fixing roller by the fixing belt at the second nip position is excessively large, a total load P2 to the sheet at the concerned position becomes higher than a total load P1 to the sheet at the first nip portion. In this case, the conveying force at the second nip portion is higher than the conveying force at the first nip portion, so that the conveying force at the second nip portion is dominant and the sheet is conveyed at the conveying speed V2 at that position.

Therefore, the conveying speed for all the sheets is changed from the conveying speed V1 at the first nip portion to the conveying speed V2 at the second nip portion and the sheet conveying speed is not stabilized. In correspondence with such a change in the conveying speed, an image slipping occurs.

For such an image slipping, in the fixing device recorded in Japanese Patent Application Publication NO. 8-166734, at the first nip portion on the upstream side, a pressure auxiliary roll of low hardness is installed on the inner peripheral surface of the fixing belt and the total load P1 to the sheet at the first nip portion becomes higher than the total load P2 to the sheet at the second nip portion on the downstream side.

However, in the fixing device recorded in Japanese Patent Application Publication No. 8-166734, to improve the separation performance and simultaneously prevent an image slipping, it is necessary to increase the total load P2 to the fixing roller at the second nip portion and also increase the total load P1 at the first nip portion and in that case, a problem of an increase in the drive torque of the fixing device and a reduction in the durability of the fixing roller arises.

With the foregoing problem in view, It is an object of the present invention to provide a fixing device and an image forming apparatus for preventing an occurrence of an image slipping without increasing the total load P1 at the first nip portion, even when the total load P2 at the second nip portion on the exit side of the fixing nip is increased to enhance the sheet separation performance.

SUMMARY

To achieve the above-described object, the present invention provides,

A fixing device comprising:

a fixing roller that has a heating section and rotates;

an endless fixing belt that is in pressure contact with the fixing roller and rotates along with the fixing roller by a rotation of the fixing roller;

a pressing member arranged on an inner peripheral surface side of the fixing belt and configured to press the fixing belt by pressurizing the fixing belt against the fixing roller, thereby forming a first nip portion between the fixing roller and the fixing belt; and a separating member arranged on a downstream side of the first nip portion in a rotational direction of the fixing belt, pressing the fixing belt from the inner peripheral surface side against the fixing roller, and deforming the outer peripheral surface of the fixing roller with a front edge of the separating member, thereby forming a second nip portion between the fixing roller and the fixing belt;

wherein the first nip portion and the second nip portion satisfy following formulas (1) and (2), $$P1\times\mu1>P2\times\mu2, \quad (1)$$

$$\mu1>\mu2, \quad (2)$$

wherein P1 represents a total load to the fixing roller applied by the pressing member at the first nip portion, P2 represents a total load to the fixing roller applied by the separating member at the second nip portion, μ1 represents a frictional coefficient between the fixing belt and the sliding surface of the pressing member, and μ2 represents a frictional coefficient between the fixing belt and the sliding surface of the separating member.

DESCRIPTION OF THE PREFERRED EMBODIMENT

The present invention will be explained on the basis of the embodiment, though the present invention is not limited to the concerned embodiment.

Figure 1:
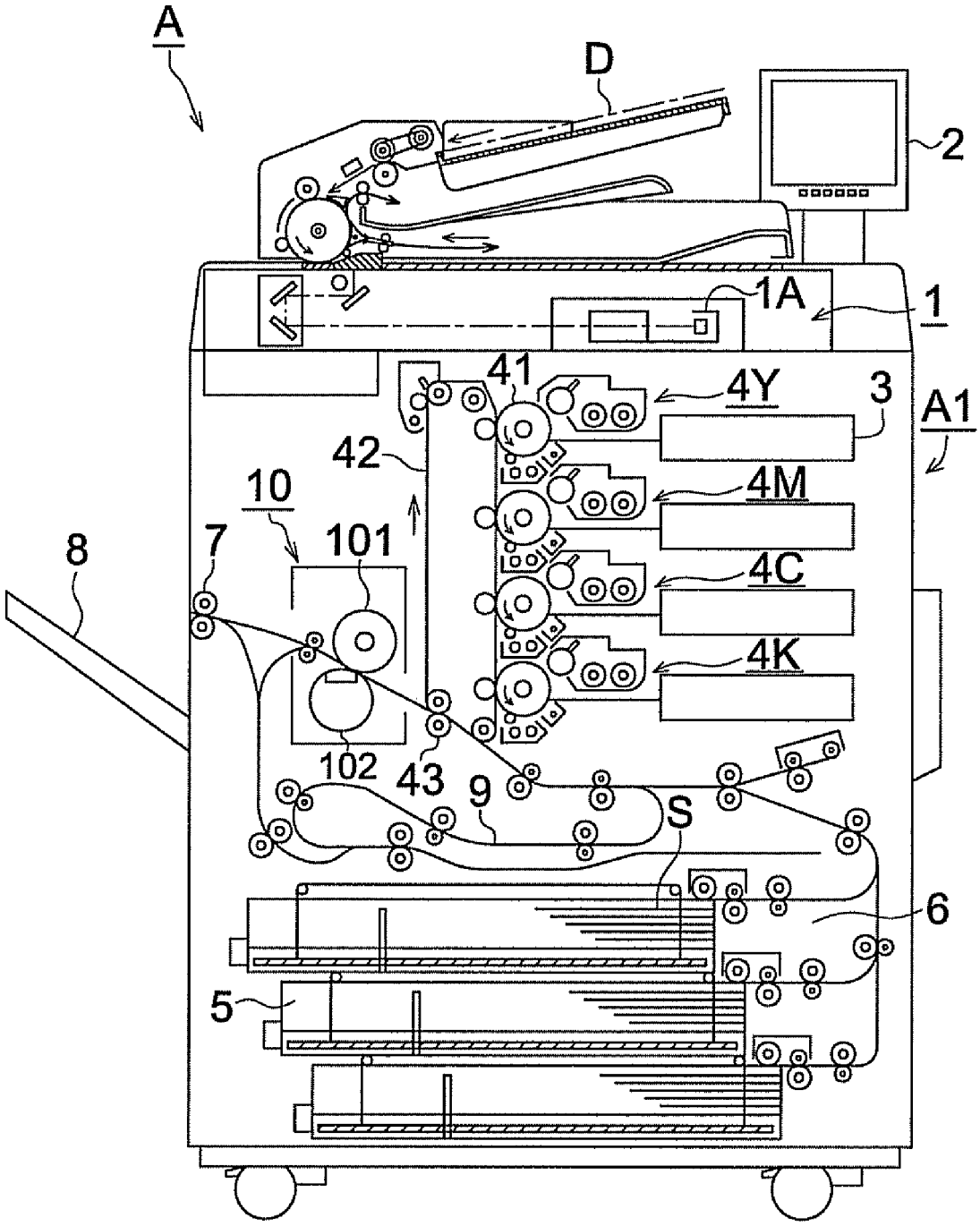
FIG. 1 is a cross sectional view at the center of the image forming apparatus relating to this embodiment.

FIG. 1 is a cross sectional view at the center of the image forming apparatus relating to this embodiment. An image forming apparatus A is referred to as a tandem type color image forming apparatus including an image forming section A1, an image reading section 1, an operation section 2, and an automatic document feeder D.

The image forming section A1 includes an image writing section 3, a plurality of sets of image preparation sections 4Y (yellow), 4M (magenta), 4C (cyan), and 4K (black), a belt type intermediate transfer medium 42, a sheet feed cassette 5, a sheet feeding section 6, a sheet ejection section 7, a duplex copy feed section 9, and a fixing device 10.

The image preparation sections 4 (4Y, 4M, 4C, 4K) have a developing means and contain respectively a 2-component developer composed of toner of small-diameter particles of each color of yellow (Y), magenta (M), cyan (C), and black (K) and a carrier.

On the upper part of the image forming apparatus A, the automatic document feeder D is loaded. A document loaded on the document table of the automatic document feeder D is conveyed in the direction of the arrow, and an image on one side or images on both sides of the document are read by the optical system of the image reading section 1 and read into a CCD image sensor 1A.

For an analog signal converted photoelectrically by the CCD image sensor 1A, the memory controller performs the analog process, A-D conversion, shading correction, and image compression and then sends a signal to the image writing section 3.

In the image writing section 3, output light from the semiconductor laser is irradiated to photosensitive drums 41 (for M, C, and K, the reference numerals are abbreviated) of the image preparation section 4 and a latent image is formed. In the image preparation section 4, the processes of charging, exposure, development, transfer, separation, and cleaning are performed. Toner images of the respective colors formed by the image preparation section 4 are sequentially transferred onto the rotating intermediate transfer medium 42 by the primary transfer means and a composite color image is formed.

The toner images on the intermediate transfer medium 42, by the transferring means 43, are transferred to a sheet S conveyed by the sheet feeding means 6 from the sheet feed cassette 5. The sheet S carrying the toner images is fixed by the fixing device 10, is ejected outside from the sheet ejection section 7, and is loaded on a sheet ejection tray 8. Or, the sheet S subject to the one-side image processing sent to the double side conveying route 9 by a transfer path switching gate not drawn is ejected again from the sheet ejection section 7 after the double-side image processing in the image preparation section 4 and is loaded on the sheet ejection tray 8.

Figure 2:
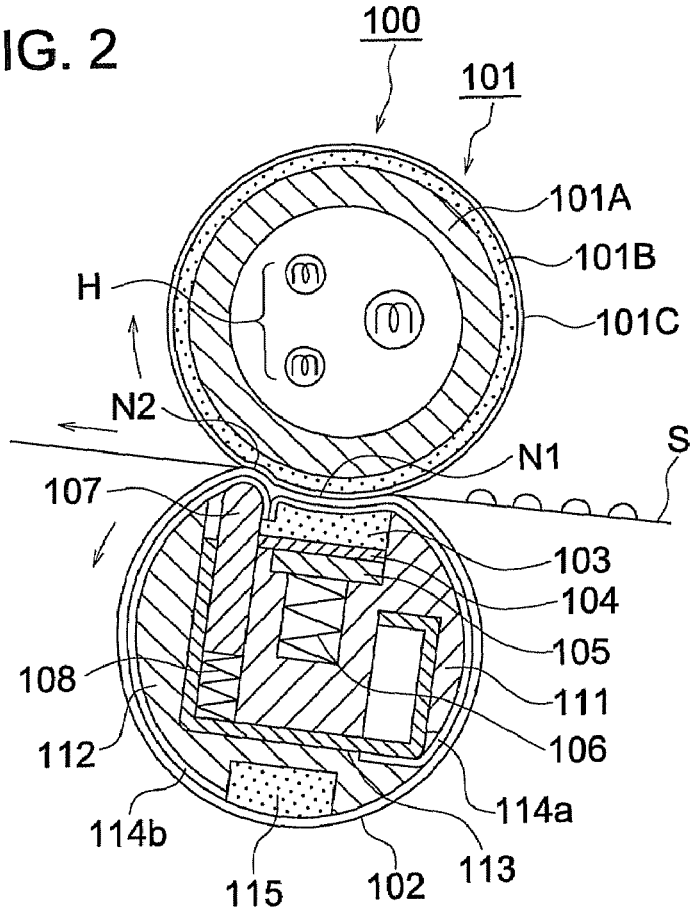
FIG. 2 is a cross sectional view of the fixing device relating to this embodiment.

FIG. 2 is a cross sectional view of the fixing device relating to this embodiment. A fixing roller 101 has a built-in tungsten halogen lamp (heating means) H at the center and is composed of a cylindrical core bar 101A made of aluminum or iron, an elastic layer 101B made of highly heat-resistant silicone rubber for covering the cylindrical core bar 101A, and furthermore a release layer 101C made of fluorine plastics such as PFA (perfluoroalkoxy) or PTFE (polytetrafluoroethylene) for covering the elastic layer 101B.

A fixing belt 102 is composed of a base formed by polyimide with a thickness of about 100 μm and a release layer formed by PFA or PTFE with a thickness of about 25 μm for covering the outer surface of the base and is formed in an endless shape.

[Pressing Member]

A pressing pad 103 is formed from silicone rubber of JIS A hardness of about 10°, is arranged on the inner peripheral side of the fixing belt 102, and is held by a holder 111 made of heat-resistant resin together with a base sheet metal 104 made of stainless steel and a base member 105 made of heat-resistant resin. Further, on the rear of the base member 105, a compression spring 106 (pressing member) is arranged and compresses the pressing pad 103 via the base sheet metal 104 and base member 105.

Here, the pressing pad 103, base sheet metal 104, base member 105, and compression spring 106 including a first sliding member 114*a* which will be described later are referred to as a pressing member.

[Separating Section]

A separation member 107 is made of heat-resistant resin or a metal such as aluminum, is arranged on the inner peripheral surface side of the fixing belt 102 and on the downstream side of the pressing pad 103 in the conveying direction of the sheet S, and is held by the holder 111 and a metallic frame 113 arranged at the center. And, with the rear end of the separation member 107, one end of a compression spring 108 (pressing member) which is a different member from the compression spring 106 is in contact and the other end of the compression spring 108 is in contact with the metallic frame 113.

Here, the separation member 107 and compression spring 108 including a second sliding member 114*b* which will be described later are referred to as a separating section.

[Sliding Member]

The pressing pad 103 has the first sliding member 114*a* in a sheet form on the surface thereof and the separation member 107 has the second sliding member 114*b* in a sheet form on the surface thereof. With respect to the first sliding member 114*a*, one end thereof is fixed to the frame 113 and the other end is fixed between the pressing pad 103 and the separation member 107. With respect to the second sliding member 114*b*, one end thereof is fixed between the pressing pad 103 and the separation member 107.

An oil pad 115 is made of sponge, contains a lubricant composed of silicone oil, is held by a holder 112 made of heat-resistant resin, is pressed to the inner peripheral surface of the fixing belt 102, and feeds the lubricant to the boundary surface between the sliding members 114*a* and 114*b* and the fixing belt 102.

Here, the frictional coefficient of the sliding members will be explained. Assuming the frictional coefficient between the inner peripheral surface of the fixing belt 102 and the first sliding member 114*a* which is a sliding surface of the pressing pad as μ1 and the frictional coefficient between the inner peripheral surface of the fixing belt 102 and the second sliding member 114*b* which is a sliding surface of the separation member 107 as μ2, the kind and material of the sliding members are selected so as to realize μ1>μ2.

For example, the second sliding member 114*b* is assumed as a Teflon (registered trademark) coated glass fiber sheet having a low frictional coefficient and the sliding member of the first sliding member 114*a* is assumed as a crosslinked PTFE sheet having a higher frictional coefficient than it. In this case, when the frictional force at time of sliding with a PTFE sheet with silicone oil coated is measured under the same condition, compared with the frictional force of the Teflon (registered trademark) coated glass fiber sheet aforementioned, the frictional force of the crosslinked PTFE sheet is higher by about two times.

During rotation of the fixing belt 102 shown in FIG. 2, the holder 111 guides the fixing belt 102 via the sliding member 114*a* and the holder 112 has a function as a guide member for directly guiding the fixing belt 102. And, the holders 111 and 112 are held by the frame 113.

In the fixing device 10 structured like this, the fixing roller 101 heated by the tungsten halogen lamp H and driven by a driving means not drawn rotates clockwise. Further, the pressing pad 103 compressed by the compression spring 106 via the base sheet metal 104 and base member 105 presses the fixing belt 102 to the fixing roller 101 via the sliding member 114*a* covering the surface thereof. Furthermore, the separation member 107 compressed by the compression spring 108 presses the fixing belt 102 to the fixing roller 101 via the sliding member 114*b* covering the surface thereof.

Here, the total load for pressing the fixing roller 101 from the pressing member including the pressing pad 103 is referred to as P1 and the total load for pressing the fixing roller 101 from the separating member including the separation member 107 is referred to as P2. The total load P2, as shown below, affects the separability of the sheet S.

Figure 3:
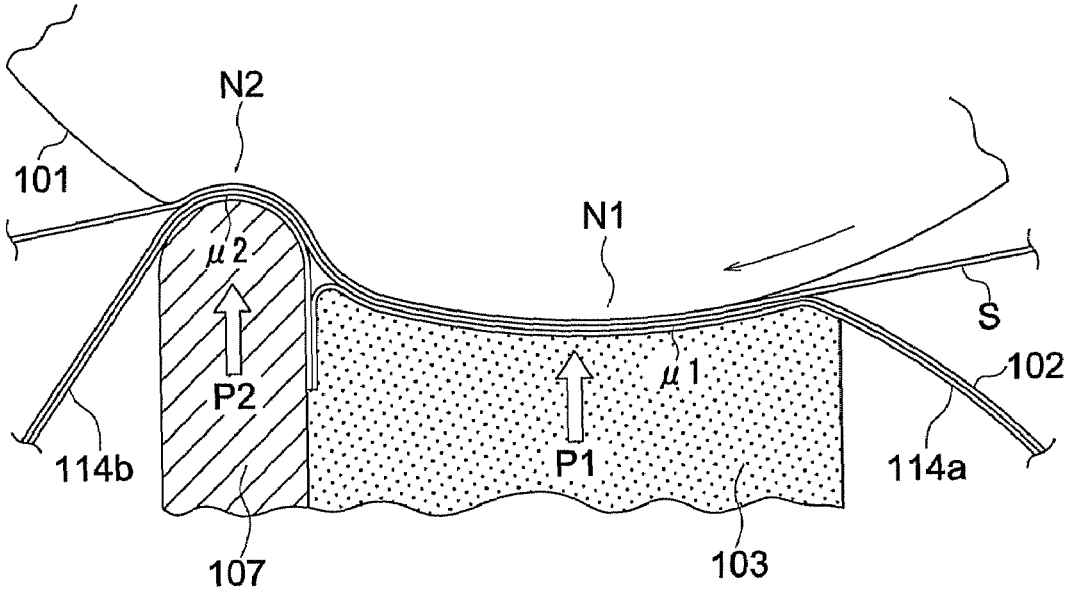
FIG. 3 is a schematic view of the enlarged periphery of the nip portion shown in FIG. 2.

FIG. 3 is a schematic view of the enlarged periphery of the nip portion shown in FIG. 2. The fixing belt 102 rotates counterclockwise by the rotation of the fixing roller 101. Here, the pressing pad 103 presses the fixing belt to the fixing roller 101, though the pressing pad 103 is softer than the fixing roller 101, so that the pressing pad 103 elastically deforms concavely together with the fixing belt 102 according to the outer peripheral surface of the fixing roller 101. In this way, between the fixing belt 102 and the fixing roller 101, a wide first nip portion N1 is formed.

Further, the separation member 107 presses the fixing belt 102 to the fixing roller 101, though the fixing roller 101 is softer than the separation member 107, so that the outer peripheral surface of the fixing roller 101 is distorted concavely according to the total load P2 from the end of the separation member 107 (elastic deformation). In this way, between the fixing roller 101 and the fixing belt 102, the second nip portion is formed.

[Countermeasure for Image Slipping]

As a result, the peripheral speed V2 of the fixing roller at the second nip portion N2 becomes higher than the peripheral speed V1 of the fixing roller at the first nip portion N1 due to an occurrence of distortion. Depending on the magnitude relationship in the frictional force (conveying force) between the first nip portion N1 and the second nip portion N2, the conveying speed of the sheets S is decided. When Fp2, a frictional force between the sheet S and the fixing roller 101 at the second nip portion N2, is larger than Fp1, a frictional force between the sheet S and the fixing roller 101 at the first nip portion N1, a phenomenon that the conveying speed is changed from V1 to V2 occurs, so that the conveying speed becomes unstable and an image may be displaced in correspondence with speed change.

To make the sheet conveying speed stable so as to prevent an occurrence of an image slipping, it is necessary to make Fp1, the frictional force between the sheet S and the fixing roller 101 at the first nip portion N1, larger than Fp2, the frictional force between the sheet S and the fixing roller 101 at the second nip portion N2.

[Countermeasure for Sheet Separability]

With respect to the first nip portion N1, the curvature center is positioned on the side of the fixing roller 101, thus the curvature is small, and the nip shape is curved small, while with respect to the second nip portion N2, the curvature center is positioned on the inner peripheral surface side of the fixing belt 102, thus the curvature is large, and the nip shape is curved large.

The second nip portion N2 is used to improve the separability when the sheet S is separated from the fixing roller 101, so that the width thereof is smaller than that of the first nip portion N1 and the inflection point formed by the first nip portion N1 and second nip portion N2 is positioned on the downstream side of the central position of the overall nip portion where the first nip portion N1 and second nip portion N2 are connected in the conveying direction.

To improve the separability of the sheet S, it is desirable to increase the total load P2 at the second nip portion N2. In correspondence with an increase in the total load P2, the concave distortion of the fixing roller 101 at the second nip portion N2, that is, the curve becomes larger, thus the sheet S can be separated easier. To ensure the separation performance, the total load P2 must be increased to a fixed amount or larger.

[Compatibility Due to Selection of Sliding Member]

However, when the total load P2 at the second nip portion is increased, the frictional force Fp2 at the second nip portion increases, so that Fp1<Fp2 becomes satisfied and the aforementioned problem of image slipping arises. To prevent the image slipping, as described previously, it is necessary to make the frictional force Fp1 at the first nip portion N1 between the sheet S and the fixing roller 101 larger than the frictional force Fp2 at the second nip portion N2.

When the sliding portions at the first and second nip portions are the same in the kind, the frictional coefficients at both positions are equal to each other, so that the magnitude relationship of the frictional force between both nip portions is decided by the magnitude relationship of the total load between the nip portions. However, in this embodiment, the sliding member 114*a* at the first nip portion N1 and the sliding member 114*b* at the second nip portion N2 are made different in the material, thus between the frictional coefficients at both nip portions, a relation of μ1>μ2 is realized. Therefore, the frictional force F1 (=P1×μ1) at the sliding member 114*a* (the pressing pad 103) at the first nip portion becomes larger than the frictional force F2 (=P2×μ2) at the sliding member 114*b* (the separation pad 107) at the second nip portion. Namely, a relation of P1×μ1>P2×μ2 is held, and the difference in the frictional force acts on the frictional forces Fp1 and Fp2 at the nip portions via the fixing belt 102, so that finally, a relation of Fp1>Fp2 is realized. Therefore, an occurrence of an image slipping can be prevented.

Further, the example that the sliding members 114*a* and 114*b* are changed in the material, thus the frictional coefficients μ1 and μ2 at the pressing member and separating member are changed is explained, though the present invention is not limited to it, and it is possible to change the surface treatment or material of the pressing pad 103 and separation member 107 without installing the sliding members at the pressing member and separating member, thereby change the frictional coefficients μ1 and μ2 with the inner peripheral surface of the fixing belt 102.

EXAMPLE

Next, the results of the experiment on how the separation performance and image slipping are changed when the total loads P1 and P2 and frictional coefficients μ1 and μ2 are changed in the level will be indicated below.

[Experimental Conditions]

Fixing roller: Diameter of 40 mm, rubber thickness of 1.0 mm, rubber hardness of 10° (JIS-A)

Fixing belt: Diameter of 35 mm, thickness of 100 μm, material of polyimide

Nip portion (first nip portion) by pressing pad: Nip width of 8 mm

Nip portion (second nip portion) by separation member: Nip width of 2.5 mm

Test sheet: coated paper (art paper), Weight per unit area of 80 g/m$^2$

Fixing temperature: Set at 180° C.

Sheet conveying speed (average): 350 mm/s

Test environment: 30° C. and 80% RH

Evaluation toner image: Solid image

[Experimental Results]

The experimental results are shown in Table 1.

TABLE 1

| | *a 1 | *a 2 | *b 1 | *b 2 | *b 3 | *b 4 | *b 5 | *b 6 |
|---|---|---|---|---|---|---|---|---|
| P1 | 150N | 150N | 150N | 200N | 175N | 250N | 200N | 150N |
| P2 | 200N | 200N | 200N | 150N | 175N | 200N | 150N | 200N |
| μ1 | 0.7 | 0.8 | 0.5 | 0.5 | 0.5 | 0.5 | 0.5 | 0.6 |
| μ2 | 0.5 | 0.5 | 0.5 | 0.5 | 0.5 | 0.5 | 0.6 | 0.5 |
| Separability | B | B | B | D | C | B | D | B |
| Image slipping | B | B | D | B | C | B | B | C |
| Durability | B | B | B | B | B | D | B | B |

*a Example

*b Comparative example

B: No defective separation, no image slipping, high durability

C: Occurrence of slight defective separation, occurrence of slight image slipping, medium durability D: Occurrence of defective separation, occurrence of image slipping, low durability A symbol P given in the table indicates a total load of the nip portion and μ indicates a frictional coefficient between the sliding member 114 and the inner peripheral surface of the fixing belt 102. An accompanying character "1" indicates the first nip portion and "2" indicates the second nip portion.

In Comparative Example 1, the frictional coefficients μ1 and μ2 are the same and a condition of P2>P1 is realized, so that the frictional force Fp2 at the second nip portion is larger than the frictional force Fp1 at the first nip portion. Therefore, a case that the conveying speed is changed to the conveying speed V2 at the second nip portion occurs, thus image slipping is caused.

In Comparative Examples 2 and 3, the total load P2 at the separating member (the second nip portion) is insufficient, so that the separation performance is insufficient. Furthermore, in Comparative Example 3, the frictional coefficients μ1 and μ2 are the same and a condition of P2=P1 is realized, so that with respect to the frictional forces, Fp1=Fp2 is held. Under this condition, an image slipping, though slight, occurs.

In Comparative Example 4, the total load P2 at the separating member is sufficient, so that the separation performance can be ensured sufficiently. Further, the relation of P1>P2 is held, so that with respect to the frictional forces, Fp1>Fp2 is held, thus no image slipping occurs. However, both total loads P1 and P2 are increased under the condition that the frictional coefficients μ1 and μ2 are the same, so that a problem arises that the drive torque of the motor for driving the fixing roller is increased and there are possibilities that the load for the fixing roller is high and the long-term durability is insufficient.

In Comparative Examples 5 and 6, the frictional coefficients μ1 and μ2 are made different from each other. Comparative Example 5 is obtained by changing the frictional coefficient of Comparative Example 2, though the total load P2 at the separating member (the second nip portion) is insufficient, so that the separation performance is insufficient. In Comparative Example 6, the total load P2 at the separating member is increased, so that the separation performance is ensured sufficiently and furthermore, with respect to the frictional coefficients, μ1>p2 is realized. However, the effect is insufficient and with respect to the frictional forces between the inner peripheral surface of the fixing belt and the sliding members, a relation of F1>F2 is not held, so that with respect to the frictional forces between the sheet S and the fixing roller, a relation of Fp1>Fp2 can be realized, so that a slight image slipping (slightly worse than that of Comparative Example 3) occurs.

On the other hand, in Examples 1 and 2, the total load P2 at the separating member is sufficient, so that the separation performance can be ensured sufficiently. Further, although the relation of P1<P2 is held, the relation of μ1>μ2 is held, so that with respect to frictional forces as a relation between the inner peripheral surface of the fixing belt and the sliding members, F1>F2 is realized. Accordingly, with respect to frictional forces as a relation between the sheet S and the fixing roller, the relation of Fp1>Fp2 can be realized, thus an occurrence of an image slipping can be prevented. Further, the sum of the total loads P1 and P2 can be made smaller than that of Comparative Example 4, so that there is an advantage that a problem of an increase in the drive torque and a reduction in the durability arises hardly.

As mentioned above, assuming the total load for the fixing roller by the pressing member at the first nip portion of the fixing device as P1, the total load for the fixing roller by the separating member at the second nip portion as P2, the frictional coefficient between the fixing belt and the pressing member as μ1, and the frictional coefficient between the fixing belt and the separating member as μ2, if the fixing device is set so as to satisfy the conditional expressions of P1×μ1>P2×μ2 and μ1>μ2, even when the total load P2 at the exit of the nip portion is increased in order to enhance the sheet separation performance, a fixing device and an image forming apparatus for preventing an occurrence of an image slipping without increasing the total load P1 at the other nip portion can be obtained.

What is claimed is:

1. A fixing device comprising:

a fixing roller that has a heating section and rotates;

an endless fixing belt that is in pressure contact with the fixing roller and rotates along with the fixing roller by a rotation of the fixing roller;

a pressing member arranged on an inner peripheral surface side of the fixing belt and configured to press the fixing belt by pressurizing the fixing belt against the fixing roller, thereby forming a first nip portion between the fixing roller and the fixing belt; and a non-rotating separating member arranged on a downstream side of the first nip portion in a rotational direction of the fixing belt, pressing the fixing belt from the inner peripheral surface side against the fixing roller, and deforming the outer peripheral surface of the fixing roller with a front edge of the separating member, thereby forming a second nip portion between the fixing roller and the fixing belt;

wherein the first nip portion and the second nip portion satisfy following formulas (1) and (2), $$P1\times\mu1>P2\times\mu2, \quad (1)$$

$$\mu1>\mu2, \quad (2)$$

wherein the fixing belt slides on the pressing member and on the separating member, P1 represents a total load to the fixing roller applied by the pressing member at the first nip portion, P2 represents a total load to the fixing roller applied by the separating member at the second nip portion, μ1 represents a frictional coefficient between the fixing belt and a sliding surface of the pressing member, and μ2 represents a frictional coefficient between the fixing belt and a sliding surface of the separating member.

2. The fixing device of claim 1 wherein the pressing member has a first sliding member on a surface thereof where the fixing belt slides and the separating member has a second sliding member on a surface thereof where the fixing belt slides.

3. The fixing device of claim 2 wherein a material of the first sliding member is different from a material of the second sliding member.

4. The fixing device of claim 1 wherein a surface treatment of the sliding surface of the pressing member is different from a surface treatment of the sliding surface of the separating member.

5. The fixing device of claim 1 wherein a material of the sliding surface of the pressing member is different from a material of the sliding surface of the separating member.

6. An image forming apparatus including the fixing device of claim 1.

* * * * *